United States Patent [19]

Hardwick et al.

[11] 4,164,973

[45] Aug. 21, 1979

[54] METHODS AND APPARATUS RELATING TO ELECTROSLAG DEPOSITION

[75] Inventors: Kenneth G. Hardwick; Trevor Bagshaw, both of Sheffield, England

[73] Assignee: British Steel Corporation, London, England

[21] Appl. No.: 908,622

[22] Filed: May 23, 1978

[51] Int. Cl.[2] ..... B22D 27/02; B22D 19/00

[52] U.S. Cl. ..... 164/52; 164/252; 164/98

[58] Field of Search ..... 164/50, 52, 250, 252, 164/91, 92, 98, 106; 13/9, 9 ES; 75/10 C, 10 R

[56] References Cited

U.S. PATENT DOCUMENTS

| | | | |
|---|---|---|---|
| 2,191,481 | 2/1940 | Hopkins | 164/52 |
| 2,437,782 | 3/1948 | Hopkins | 164/52 |
| 2,525,133 | 10/1950 | Hopkins | 164/52 |
| 3,777,106 | 12/1973 | Nuccel | 13/9 ES |
| 3,789,908 | 2/1974 | Ruget | 164/52 |

FOREIGN PATENT DOCUMENTS

| | | | |
|---|---|---|---|
| 2313157 | 12/1976 | France | 164/252 |

*Primary Examiner*—Othell M. Simpson
*Assistant Examiner*—K. Y. Lin
*Attorney, Agent, or Firm*—Bacon & Thomas

[57] ABSTRACT

Electroslag casting methods and apparatus continuously deposit metal on to the surface of an elongate metal article such as a steel mill roll, supported with its axis substantially vertical with respect to an open ended mould positioned around the surface of the article. A vertically movable platform is adapted to encompass the articles, and carries one or more feed devices for feeding, in the form of a consumable electrode, the metal which is to be deposited onto the surface of the article into the space defined between the sides of the mould and the article. The platform can be driven vertically and means are provided for coupling the mould to the platform after a predetermined vertical movement of the platform.

14 Claims, 3 Drawing Figures

METHODS AND APPARATUS RELATING TO ELECTROSLAG DEPOSITION

This invention relates to apparatus for and a method of depositing metal by an electroslag casting process on to the surface of elongate metal articles such as steel mill rolls or metallic arbors.

According to the present invention in one aspect electroslag casting apparatus for continuously depositing metal on to the surface of an elongate metal article comprises means for supporting the article with its axis substantially vertical, a vertically movable platform which is adapted to encompass the article, and open ended mould positionable around the article with its internal surface spaced a predetermined distance away from the surface of the article, means carried by the platform for continuously feeding the metal in the form of a consumable electrode which is to be deposited onto the surface of the article into the space defined between the opposed surfaces of the mould and the article, means for imparting vertical movement to the platform and means for coupling the mould to the platform after a predetermined vertical movement of the platform relative to the mould.

The article may comprise a steel mill roll or a metallic tubular or solid arbor and the mould, which may be circular in cross-section, is preferably positioned around such an article with its axis substantially coaxial with that of the article.

The feeding means for such electrodes may be mounted on a table which is supported on the platform for oscillatory movement relative to the mould in a horizontal plane about a path parallel to the mould circumference. The electrodes may comprise wires and the electrode feeding means may include welding heads inclined downwardly towards the annular space defined between the opposed surfaces of the mould and the article.

Preferably the platform includes a well portion within which is located the mould, the well portion comprising at its lower end one or more inwardly extending flanges initially positioned a predetermined distance below the mould and including means which co-operate with the mould to couple the mould to the platform. The coupling means may comprise one or more upstanding dowels located directly below apertures formed in an outwardly extending flange portion of the mould; a locking device may be provided to secure the mould to the platform once the dowels have been engaged in the apertures.

According to the present invention in another aspect a method of depositing metal about the surface of an elongate metal article by an electroslag casting process comprises the steps of supporting the article with its axis substantially vertical, locating a mould about the perimeter of the article, forming within the mould a bath of molten electrically conductive slag, feeding into the molten slag one or more consumable electrodes which carry electrical current to the slag and which progressively melt to produce the weld metal which is to be deposited about the surface of the article, initially maintaining the mould stationary to permit the weld metal within the mould to rise to a predetermined level and subsequently causing the mould to move vertically such that it progressively moves over the surface of the article on which weld metal is to be deposited. Preferably, the level of molten slag within the mould is maintained substantially constant during vertical movement of the mould over the surface of the article.

The electrodes may comprise wires fed from welding heads supported on a vertically movable platform initially rising independently of the mould for a predetermined distance and then supporting the mould as it moves progressively over the surface of the article on which weld metal is to be deposited.

Preferably, the welding heads are oscillatable relative to the mould to ensure that the entire peripheral length of the exposed surface of the molten slag is traversed by the electrode wires. The welding heads may be movable both circumferentially and radially relative to the mould.

BRIEF DESCRIPTION OF THE DRAWINGS

The invention will now be described with reference to the accompanying diagrammatic drawings, in which.

Figure 1:
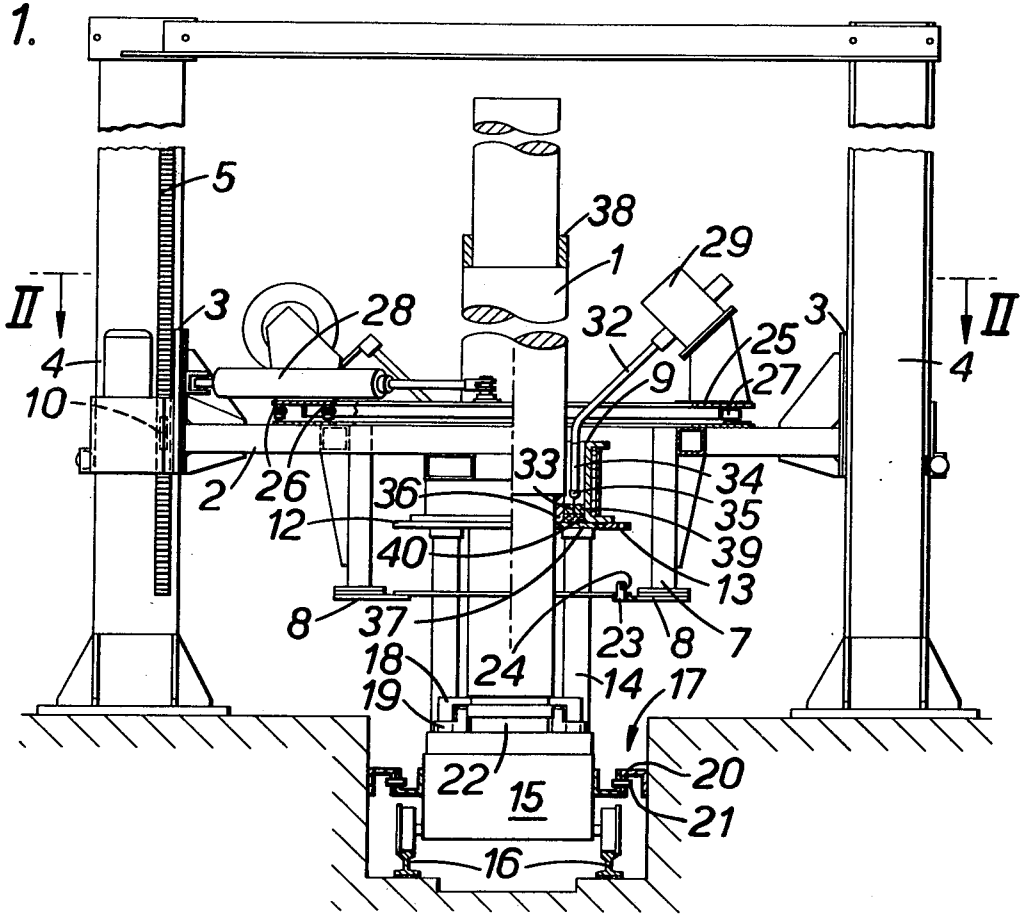
FIG. 1 is a side elevational view of apparatus in accordance with the invention.
Figure 2:
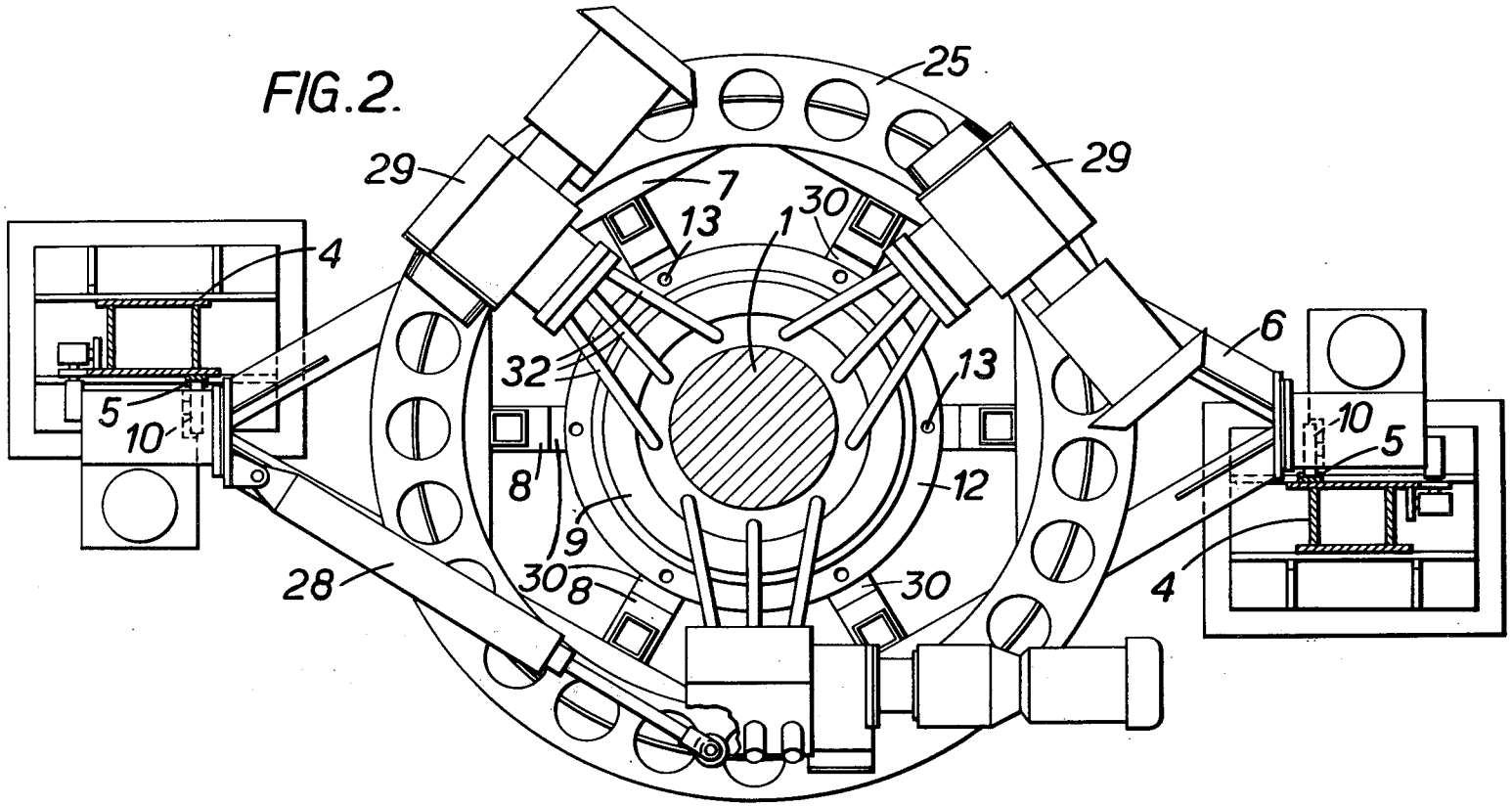
FIG. 2 is a plan view taken along line II—II of FIG. 1.

The apparatus illustrated in the drawings will be described with reference to the resurfacing or cladding of the barrel of a steel mill roll 1. It will be appreciated however, that other elongate metal articles such as specially manufactured abors can also be surfaced using the apparatus to be described. The apparatus comprises a ring-shaped platform 2 supported by carriages 3 movable vertically along a pair of upright columns 4. The carriages 3 are moved by motor-driven pinions 10 which engaged racks 5 formed in the columns 4. It is to be understood, however, that alternative means may be employed to drive the carriages along the columns. The platform 2 comprises an outer annular portion 6 and a central well portion 7 which includes a plurality of flanges 8 extending radially inwardly from its lower open end.

A water-cooled mould 9 is juxtaposed with the platform 2 by being located within the platform well 7 with its axis substantially coincident with that of the roll 1. The mould includes a lower outwardly extending annular flange 12 which has formed in its surface six equally spaced holes 13. Initially, the mould 9 (as shown in FIG. 1) is supported by a frame 14 comprising four adjustable support columns which is, in turn, supported on a motor-driven trolley 15 which runs along a track 16. The trolley 15 is located centrally in a pit 17 by pairs of cooperating brackets 20 and locating pin 21 and also carries a support structure which locates and clamps the roll 1, radially and vertically, in the upright position required for resurfacing. The support structure includes radially adjustable locking jaws 18, 19 and a metallic base member 22. The jaws 18, 19 serve to lock the roll 1 in the required position and the height of the base member 22 is selected to ensure that the roll barrel is at the required height for resurfacing.

Figure 3:
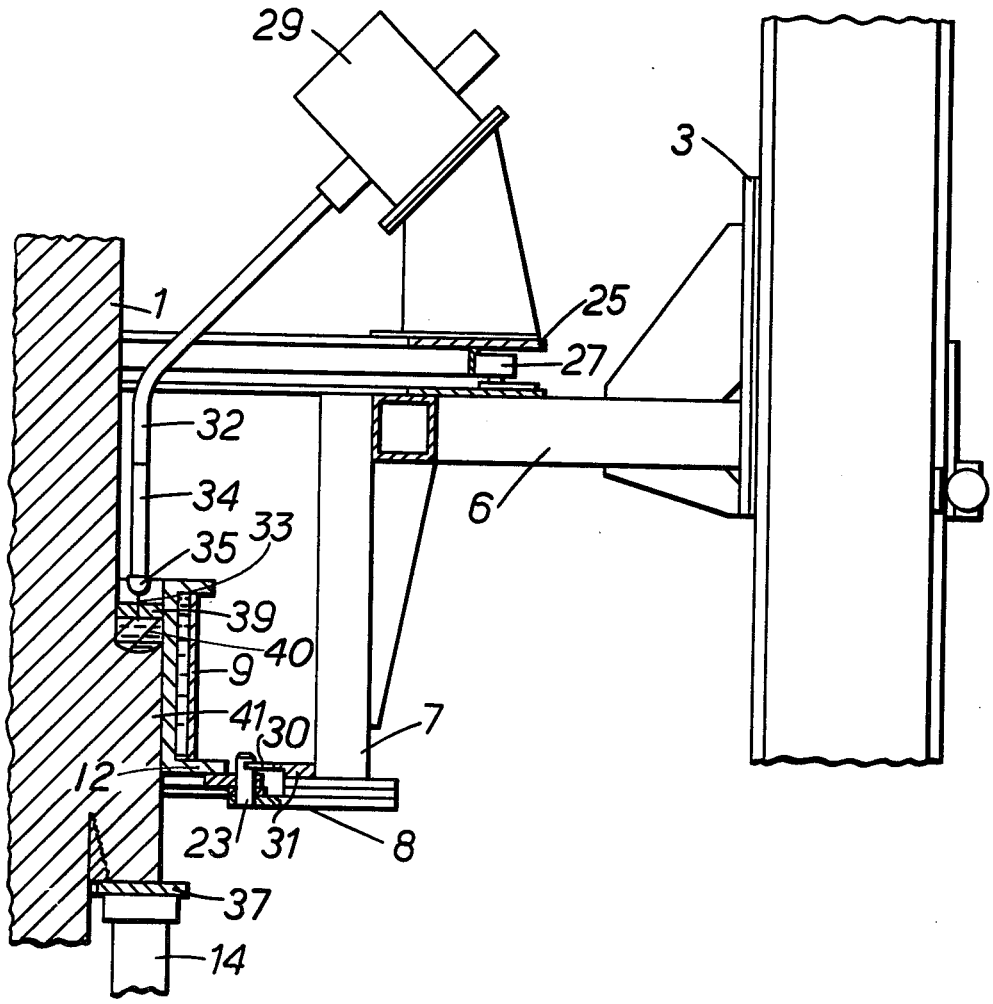
FIG. 3 is a detail of the apparatus illustrated in FIGS. 1 and 2 showing the respective positions to several intergers when the apparatus is in operation.

Each hole 13 formed in the mould flange 12 is positioned directly above an upstanding dowel 23 carried by one of the flanges 8. Initially, the mould 9 is supported on the frame 14 a predetermined distance above the flanges 8. However, as will be described below, during the course of the resurfacing operation, the platform 2 rises relative to the mould 9 so that, in time, the dowels 23 enter the respective holes 13 to couple the mould 9 to the platform 6 as shown in FIG. 3. Each dowel 23 includes a recess 24 into which a key 30 formed on the inner circumference of a rotatable ring 31 attached by a bracket to the platform well 7 can be inserted to lock the mould to the platform and ensure common movement of the platform and the mould for the remainder of the process.

The outer annular portion 6 of the platform supports a ring-shaped table 25 which oscillates in a horizontal plane about a path parallel to the mould surface. The table 25 is supported on bearings 26 and is oscillated in contact with guide rolls 27 by a pivotally mounted pneumatic piston 28. The table 25 carries three equally spaced welding heads 29 which are inclined downwardly towards the annular space defined between the opposed surfaces of the roll 1 and the mould 9. The welding heads 29 are each movable in a radial sense towards and away from the mould 9 to allow it to be correctly positioned relative to the mould and in a circumferential sense to compensate for variations in the number of electrode wires required for resurfacing rolls of different diameter. Each welding head 29 includes three heat-resistant nozzles 32 through which electrode wires 33 can be introduced into the mould space. Wire feeding reels (not shown) are mounted on the table 25 or to one side of the table and deliver electrode wire to each of the nozzles 32. Alternatively, the wire feed heads may be independent single nozzle units each utilising its own wire feed drive and control system.

Each nozzle 32 comprises a thick walled metal tube having an expendable lower section 34 screwed into the main nozzle section and on alumina silicate ceramic cup-shaped end-portion 35 screwed into the expendable lower section 34.

Prior to a resurfacing operation, the platform 2 is raised and the bogie 15 with the roll 1 (which may be preheated) clamped in the position indicated in FIG. 1, is moved into position below the platform well 7. The mould 9 may be mounted on the frame about the surface of the roll barrel prior to movement of the bogie into the position shown or may be lowered onto the frame 14 by means of the platform 2. A metal "run-on" ring 36 is attached to the underside of the lower end of the roll barrel substantially flush with the surface of the roll barrel and the lower open end of the mould is initially closed by an outwardly extending annular plate 37 supported in the frame 14. A metal ring 38 similar to the "run-on" ring 36 is welded to the top end of the roll substantially flush with the roll barrel surface to act as a "run-off" to ensure satisfactory termination of the cladding at the top end of the barrel. The mould 9 is also positioned that the lower end of the roll barrel is located within the lower portion of the mould and the nozzles 32 are positioned so that their expendable sections 34, depend into the upper open end of the mould with the electrode wires 33 extending to positions just above the upper surface of the closure plate 37.

At start-up, a quantity of molten slag 39 is introduced into the mould from above (or initially melted in situ within the mould) to a level above the ends of the electrode wires 33 to complete the power circuit. After obtaining stable operating conditions with current flowing from the wires 33 to the roll via the slag bath 39, the table 25 is oscillated to ensure that the entire peripheral length of the exposed slag surface is traversed by the electrode wires 33 to give a consistent temperature distribution throughout the slag bath 39. Preferably the speed of oscillation is adjustable between the limits of 15 and 60 meters per hour, with a dwell time at each extreme of the reciprocation motion of between 0 and 7 seconds. Alternating electrical current from a transformer (not shown) is passed through the electrode wires 33 and passes from the molten slag 39 through the roll to the base member 22; a conventional connector secured to the member 22 returns the electrical current via conventional cables (not shown) to the transformer. Alternatively the return path for current to the transformer may be via a connection located on the mould 9 or closure plate 37. The electrical current passing through the molten slag 39 maintains it at a temperature at or above the melting point of the electrode wires 33. Metal melted off from the wires 33 falls through the slag 39 in droplet form and collects in a pool of liquid metal 40 below the slag. Initially this liquid metal collects within the well defined by the closure plate 37, lower end of the mould 9 and the starter ring 36. The depth of the well is such that steady melting conditions have been attained once the liquid metal of the pool comes into contact with the lower edge of the roll barrel.

As the metal pool 40 increases in depth, the platform 2 is raised by the carriages 3 to maintain the ceramic end-portions 35 of the nozzles 32 a predetermined distance above the slag surface. Simultaneously, electrode wires 33 are fed through the nozzles 32 to maintain a given depth of wire immersion with the liquid slag 39. The surface of the roll 1 in contact with the liquid slag 39 and metal 40 melts to a limited extent thus providing a good bonding surface for the weld metal as it progressively freezes to form a resurfaced layer 41 (see FIG. 3).

Initially, the platform 2 and the welding heads 29 move upwardly relative to the mould 9 to enable a substantial depth of solidified weld metal 41 to be present in the mould before vertical movement of the mould itself takes place. This is to ensure that sufficient solidified metal is present to prevent leakage of molten metal from the lower end of the mould once the mould has been raised from its seating on the closure plate 37. When the platform has been raised by a distance equal to the initial gap between the mould 9 and the flanges 8, the dowels 23 enter the holes 13 formed in the mould flange 12 and the ring 31 rotated to move the keys 30 into the recesses 24 to couple the mould to the platform 2; once so coupled, the mould 9 moves upwardly with the platform 2 along the entire length of the roll barrel. Movement of the platform is controlled to maintain a predetermined depth of immersion of the electrode wires within the slag 39. When the resurfaced layer 41 extends over the entire roll barrel, the electrical current is switched off and the electrode wires 33 are withdrawn from the slag 39. The ring 38 prevents damage to the upper roll journal due to contact with the slag 39.

A heat shield (not shown) may be provided to prevent too rapid cooling of the article after it has been resurfaced. The heat shield may, for example, comprise a flexible metallic skirt which depends from the underside of the mould.

After completion of the resurfacing operation the platform 2 and mould 9 are raised by the carriage 3 to allow the bogie mounted resurfaced roll to be withdrawn.

We claim:

1. Electroslag casting apparatus for continuously depositing metal onto the surface of an elongate metal article comprising: means for supporting the article with its axis substantially vertical, a vertically movable platform which is adapted to encompass the article, an open ended mould initially juxtaposed in selected spaced relation with the platform positioned around the article with an internal surface opposed to and spaced a predetermined distance away from the surface of the article to define a space between the surfaces, means carried by the platform for continuously feeding the metal in the form of a consumable electrode, which is to be deposited onto the surface of the article into the space defined between the opposed surfaces of the mould and the article, means for imparting vertical movement to the platform sufficient to enable a predetermined depth of solidified weld metal to be present in the mould and means for coupling the mould to the platform after a predetermined vertical movement of the platform relative to the mould, whereby the mould may be moved vertically by the platform.

2. Apparatus as claimed in claim 1 wherein the elongate metal article is a steel mill roll and wherein the mould is positionable around the roll with its axis substantially coaxial with that of the roll.

3. Apparatus as claimed in claim 1 wherein the feeding means for the consumable electrodes is mounted on a table which is supported on the platform for oscillatory movement relative to the mould in a horizontal plane about a path parallel to the mould circumference.

4. Apparatus as claimed in claim 3 wherein the electrodes comprise consumable wires and wherein the electrode feeding means includes welding heads inclined outwardly towards the annular space defined between the opposed surfaces of the mould and the article.

5. Apparatus as claimed in claims 1, 2, 3 or 4 wherein the platform includes a well portion within which the mould is located, the well portion comprising at its lower end, one or more inwardly extending flanges which are initially positioned a predetermined distance below the mould and which include means which cooperate with the mould to couple the mould to the platform.

6. Apparatus as claimed in claim 1 wherein the platform includes a well portion within which the mould is located, the well portion comprising at its lower end, one or more inwardly extending flanges which are initially positioned a predetermined distance below the mould and which include means which cooperate with the mould to couple the mould to the platform, and wherein the coupling means comprises one or more upstanding dowels located directly below apertures formed in an outwardly extending flange portion of the mould.

7. Apparatus as claimed in claim 6 wherein a locking device is provided to secure the mould to the platform once the dowels have been engaged in the apertures.

8. Apparatus as claimed in claim 7 wherein the locking device comprises a number of inwardly extending key members located on the inner periphery of a rotatable annular ring member, the ring member being movable to move the key members into and out of slots formed in the dowels.

9. A method of depositing metal about the surface of an elongate metal article by an electroslag casting process comprising the steps of: supporting the article with its axis substantially vertical, locating a mould about the perimeter of the article and providing a vertically movable means adjacent the mould, forming within the mould a bath of molten, electrically conductive slag, feeding into the molten slag at least one consumable electrode which carries electrical current to the slag and which progressively melts to produce weld metal which is to be deposited about the surface of the article, initially maintaining the mould stationary to enable a predetermined depth of solidified weld metal to be present in the mould and subsequently causing the mould to move vertically by coupling the vertically movable means with the mould after a predetermined vertical movement of the vertically movable means such that they progressively move over the surface of the article on which weld metal is to be deposited.

10. A method as claimed in claim 9 further including the step of maintaining the level of molten slag within the mould substantially constant during vertical movement of the mould over the surface of the article.

11. A method as claimed in claim 9 wherein said vertically movable means is a platform; there are a plurality of electrodes, each comprising consumable wires and further including the steps of: feeding the wires from welding heads supported on said platform, initially moving the platform upwardly independently of the mould for a predetermined distance and thereafter supporting the mould on the platform as the platform moves progressively over the surface of the article on which weld metal is being deposited.

12. A method as claimed in claim 10 further including the step of oscillating the welding heads relative to the mould to traverse the entire peripheral length of the exposed surface of the molten slag by the electrode wires.

13. A method as claimed in claim 11 further including the step of moving the welding heads both circumferentially and radially relative to the mould.

14. Apparatus as recited in claim 2, wherein the feeding means for the consumable electrodes is mounted on a table which is supported on the platform for oscillatory movement relative to the mould in a horizontal plane about a path parallel to the mould circumference.

* * * * *